US008359686B2

(12) United States Patent
Hunter et al.

(10) Patent No.: US 8,359,686 B2
(45) Date of Patent: Jan. 29, 2013

(54) PILLOW

(75) Inventors: Tammy-Jo Hunter, Driver (AU); Edward Joseph Khoury, Bateman (AU)

(73) Assignee: Tammy-Jo Hunter, Driver (AU)

( * ) Notice: Subject to any disclaimer, the term of this patent is extended or adjusted under 35 U.S.C. 154(b) by 0 days.

(21) Appl. No.: 13/260,863

(22) PCT Filed: May 13, 2010

(86) PCT No.: PCT/AU2010/000559

§ 371 (c)(1), (2), (4) Date: Sep. 28, 2011

(87) PCT Pub. No.: WO2010/130003

PCT Pub. Date: Nov. 18, 2010

(65) Prior Publication Data

US 2012/0017374 A1 Jan. 26, 2012

(30) Foreign Application Priority Data

May 13, 2009 (AU) ..... 2009902149

(51) Int. Cl.
*A47G 9/10* (2006.01)

(52) U.S. Cl. ..... 5/638; 5/636

(58) Field of Classification Search ..... 5/638, 636, 5/632, 630, 740, 724, 725, 655.9, 652.1, 5/953

See application file for complete search history.

(56) References Cited

U.S. PATENT DOCUMENTS

| | | | | | |
|---|---|---|---|---|---|
| 2,295,906 | A * | 9/1942 | Lacour | 5/636 |
| 3,124,812 | A * | 3/1964 | Milton et al. | 5/638 |
| 3,400,413 | A * | 9/1968 | La Grossa | 5/639 |
| 4,118,813 | A * | 10/1978 | Armstrong | 5/638 |
| 4,349,925 | A | 9/1982 | Macomber | |
| 4,821,355 | A | 4/1989 | Burkhardt | |
| 5,528,784 | A * | 6/1996 | Painter | 5/640 |
| 5,708,998 | A | 1/1998 | Torbik | |
| 5,727,267 | A * | 3/1998 | Keilhauer | 5/636 |
| 6,095,894 | A * | 8/2000 | Stevens | 450/57 |
| 6,484,336 | B1 * | 11/2002 | Berke et al. | 5/636 |
| 6,574,809 | B1 * | 6/2003 | Rathbun | 5/636 |
| 6,668,404 | B2 | 12/2003 | Lanteri | |
| 6,915,539 | B2 * | 7/2005 | Rathbun | 5/636 |
| 6,941,603 | B2 | 9/2005 | Radice | |
| 8,161,588 | B1 * | 4/2012 | Anson | 5/636 |
| 2003/0000018 | A1 * | 1/2003 | Lanteri | 5/636 |
| 2009/0139031 | A1 * | 6/2009 | Davis et al. | 5/639 |
| 2012/0017374 | A1 * | 1/2012 | Hunter et al. | 5/638 |
| 2012/0060292 | A9 * | 3/2012 | Davis | 5/636 |

* cited by examiner

*Primary Examiner* — Robert G Santos

(74) *Attorney, Agent, or Firm* — Hamre, Schumann, Mueller & Larson, P.C.

(57) ABSTRACT

A pillow 10 for sleeping on a bed is described. The pillow 10 comprises a body 12 of generally rectangular configuration, the body 12 being made from a resilient cushioning material and having a corner cut-away to form a recessed portion 14. In use, the recessed portion 14 permits unrestricted breathing when a user is sleeping on their side.

10 Claims, 6 Drawing Sheets

(b)

(a)

PILLOW

FIELD OF THE INVENTION

The present invention relates to a pillow and relates more particularly to a pillow with a profile designed for improved head and neck support.

BACKGROUND TO THE INVENTION

Having a comfortable pillow which provides proper head and neck support is important not only for getting a good night's sleep, but also for maintaining the correct spinal posture while sleeping. However a problem with many prior art pillows is that while they are soft and comfortable to rest the head on, they do not provide adequate neck support. During the night, while the head rests on the pillow, there is little or no support for the neck, and as a consequence the neck muscles and spine can become strained. A further problem with most prior art pillows is that when the user is sleeping on their side, with their head resting on the pillow, the nose and nasal passages, and the mouth, and therefore breathing, can become constricted by the pillow. Hence there is a tendency for people to sleep with their head on the edge of the pillow, so as to leave their nose and mouth exposed and allow free-flow breathing. However this exacerbates the problem of inadequate neck support.

The present invention was developed with a view to providing a pillow with a profile designed for improved head and neck support.

The previous discussion of the background to the invention is provided for illustrative purposes only and is not to be taken as an acknowledgement or admission that any of the material referred to is or was part of the common general knowledge in Australia or elsewhere as at the priority date of this application.

SUMMARY OF THE INVENTION

According to one aspect of the present invention there is provided a pillow for sleeping on a bed, the pillow comprising:

a body of generally rectangular configuration, the body being made from a resilient cushioning material and having a corner cut-away to form a recessed portion wherein, in use, the recessed portion permits unrestricted breathing when a user is sleeping on their side.

Preferably the recessed portion is one of a plurality of recessed portions formed in the body of the pillow. Typically two recessed portions are formed at respective cut-away corners of the body.

Preferably the resilient cushioning material is a foam material. Advantageously the foam material is perforated. Preferably the perforations pass through the foam material from an upper surface of the body to a lower surface of the body. Preferably the perforations are substantially linear and parallel to one another. The perforations may be of varied diameter and distribution throughout the body of the pillow to vary the density (softness) of the cushioning material. Preferably the perforations are uniformly distributed throughout the body. Typically the foam material is latex foam.

Preferably the upper surface of the body is contoured with a concave shape and is adapted to support the head and neck of a user while sleeping on their back. Preferably the body has slightly raised sides at each end for supporting the head and neck of a user when sleeping on their side. Preferably the lower surface of the body is similarly contoured.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWINGS

The nature of the invention will be better understood from the following detailed description of several specific embodiments of the pillow, given by way of example only, with reference to the accompanying drawings, in which:

FIGS. 2(*d*) and (*e*) show respectively section views through the lines A-A and B-B of the pillow as shown in FIG. 2(*a*);

DETAILED DESCRIPTION OF PREFERRED EMBODIMENTS

Figure 1:
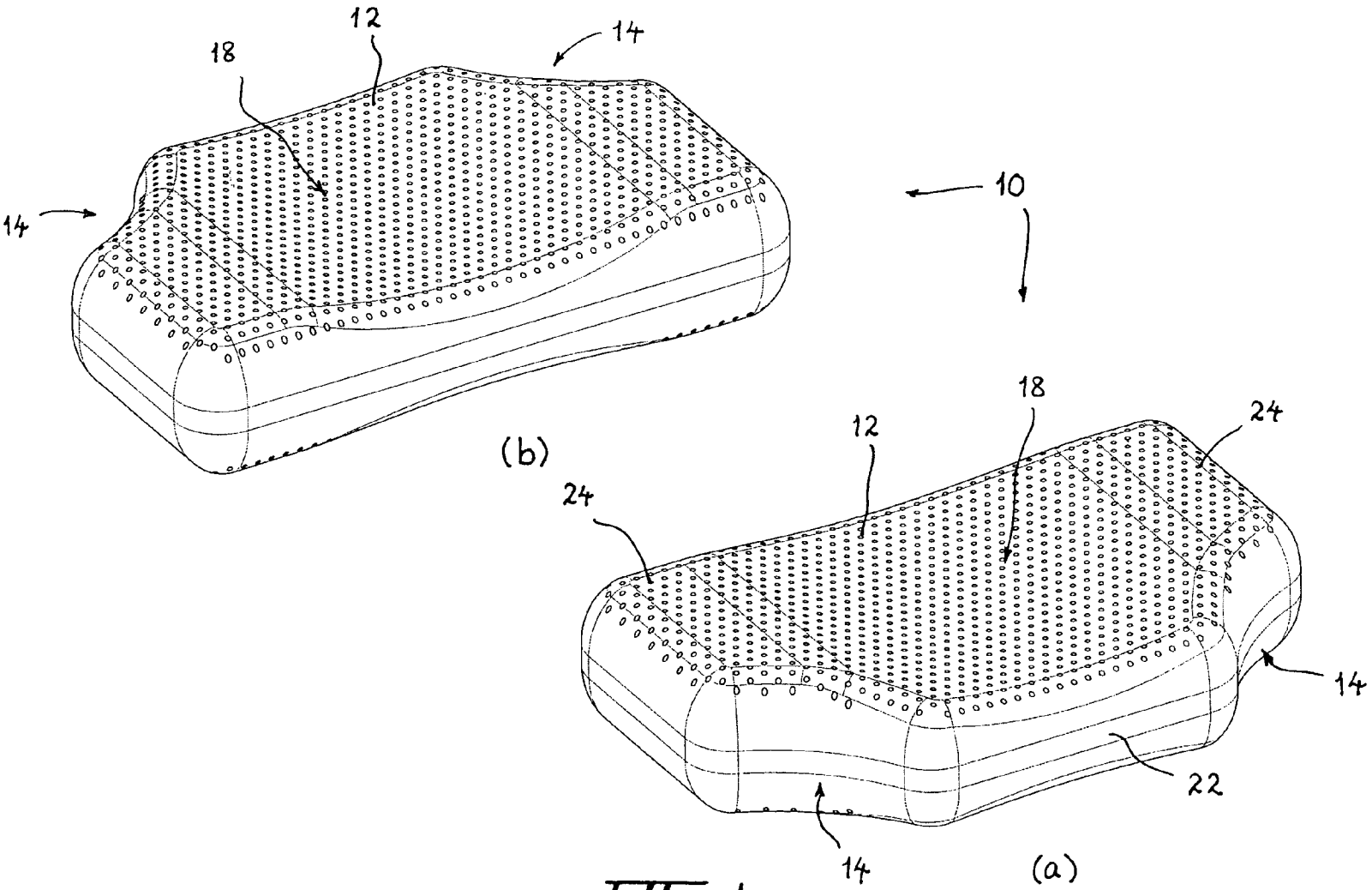
FIGS. 1(*a*) and (*b*) show respectively a front and back perspective view of a preferred embodiment of a pillow according to the invention.

A preferred embodiment of a pillow 10 in accordance with the invention, as illustrated in FIGS. 1 to 6, comprises a body 12 of generally rectangular configuration. The body 12 of the pillow 10 is made from a resilient cushioning material and has two corners cut-away to form recessed portions 14. As can be seen most clearly in FIG. 6, in use, the recessed portions 14 permit unrestricted breathing when a user is sleeping on their side. With the head resting on the side 24 of the body 12 of the pillow, the mouth and nose of the user are fully exposed over the edge of the pillow in the region of the recessed portion 14, thus permitting unrestricted and free-flowing movement of air into and out of the nose and/or mouth.

Preferably the resilient cushioning material from which the body 12 is moulded is a foam material, such as latex foam. Natural latex is derived from the sap of the rubber tree and is naturally hypo-allergenic, dust-mite resistant, anti-microbial, and inhibits the growth of bacteria, mould, and mildew. When resting the body on latex foam it immediately conforms to the contours of the body, creating a cushioning effect in which no pressure points are built up while resting or sleeping. Latex is also highly resilient, so that a pillow made from latex bounces back into shape of its own accord and never needs fluffing like a pillow made from conventional material. The latex foam also does not bunch or flatten over time as conventional cushioning materials tend to do. However the invention is not limited to pillows made from latex foam or even other foam materials. Some of the same benefits of the present invention can still be obtained with pillows made from other cushioning materials.

Advantageously the latex foam material from which the body 12 is made has perforations 16. As can be seen most clearly in FIGS. 2(*d*) and (*e*), the perforations 16 preferably pass all the way through the foam material from an upper surface 18 of the body 12 to a lower surface 20 of the body 12. The perforations 16 are substantially linear and parallel to one another. In the illustrated embodiment the perforations 16 are uniformly distributed throughout the body 12. However the hole size (diameter) of the perforations 16, and their distribution throughout the body 12 of the pillow, may be varied to vary the density/softness of the pillow. Perforations having a smaller hole diameter provide a denser pillow, whereas perforations with a larger diameter provide a pillow which is more flexible (softer). The perforations 16 improve the breathability of the foam material, and enhance its softness without compromising the head and neck support offered by the body 12.

Figure 2:
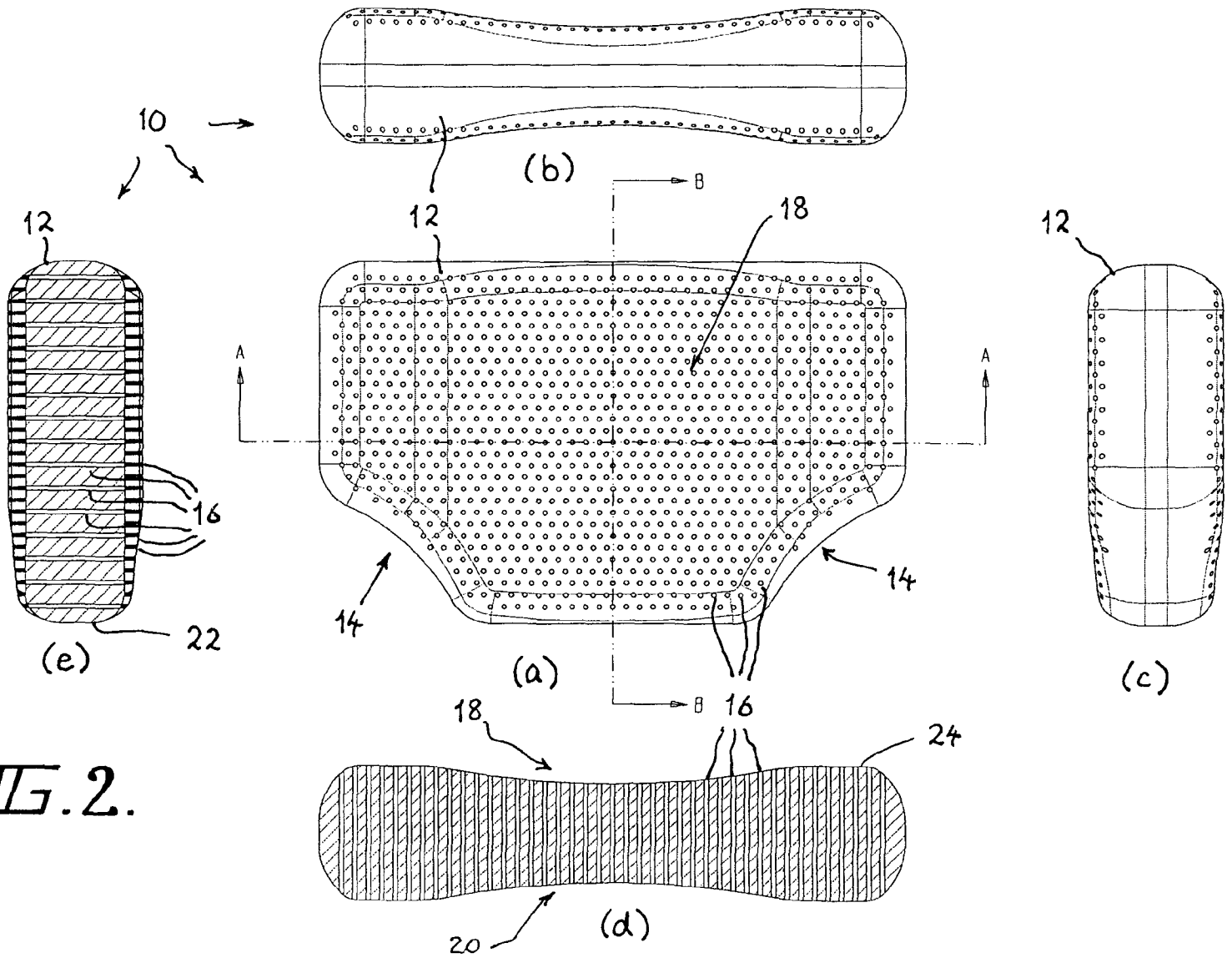
FIGS. 2(*a*), (*b*) and (*c*) show respectively a plan view, a side elevation and end elevation of the pillow of FIG. 1.
Figure 4:
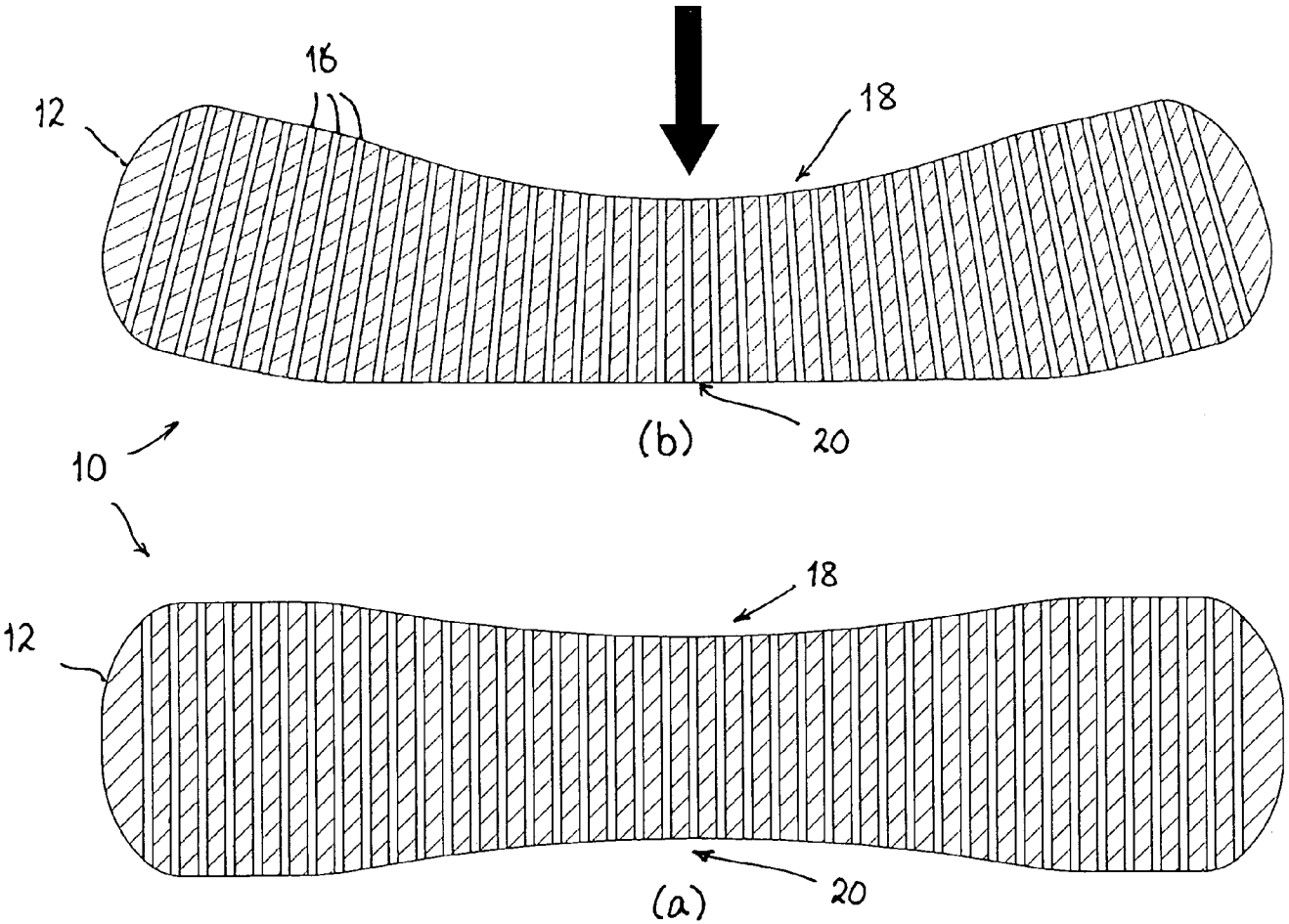
FIGS. 4(*a*) and (*b*) show how the pillow of FIG. 1 bends to accommodate a load applied to an upper surface of the pillow.
Figure 5:
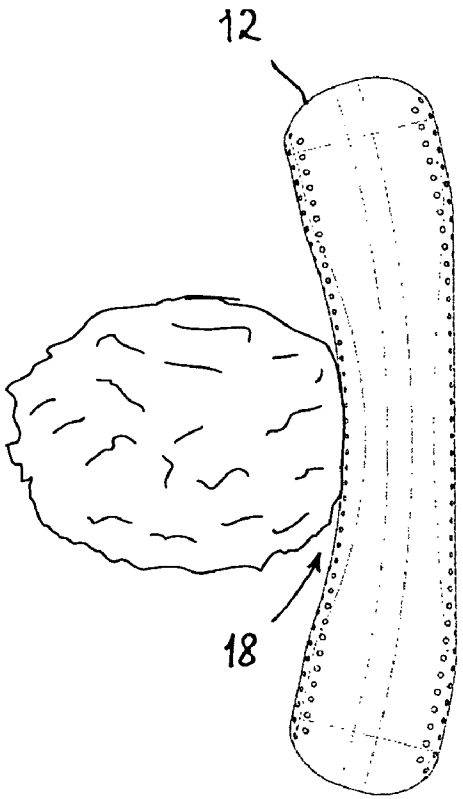
FIGS. 5(*a*) and (*b*) show respectively in top plan view and side elevation how the pillow of FIG. 1 supports the head and neck of a user when sleeping on their back.
Figure 5:
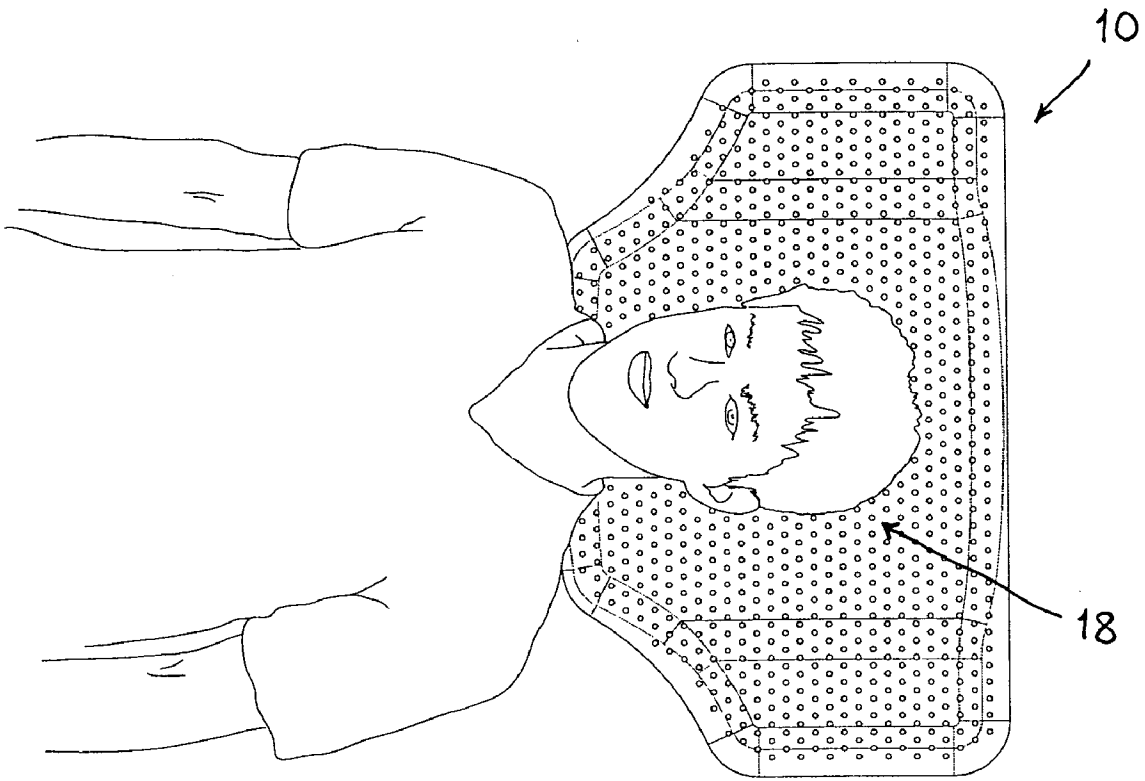

Preferably the upper surface 18 of the body 12 is contoured with a concave shape as can be seen most clearly in FIGS. 2(*b*) and (*d*) and FIG. 4. The concave shape of the upper surface 18 of the body 12 is adapted to support the head and neck of a user while sleeping on their back (see FIG. 5). The concave shape of the upper surface 18 creates a slight depression in which the head can rest whilst the neck is still supported by the front edge 22 of the pillow. Preferably the upper surface 18 is also contoured with a slight downwards inclination towards the front edge 22, as can be seen most clearly in FIGS. 2(*c*) and (*e*). Typically the lower surface 20 of the body 12 is similarly contoured with a concave shape. Hence when a load is applied to the upper surface of the body 12, as shown in FIG. 4(*a*), not only does the cushioning material of the pillow depress, but the body 12 also bends, as shown in FIG. 4(*a*), to accommodate the load.

Figure 6:
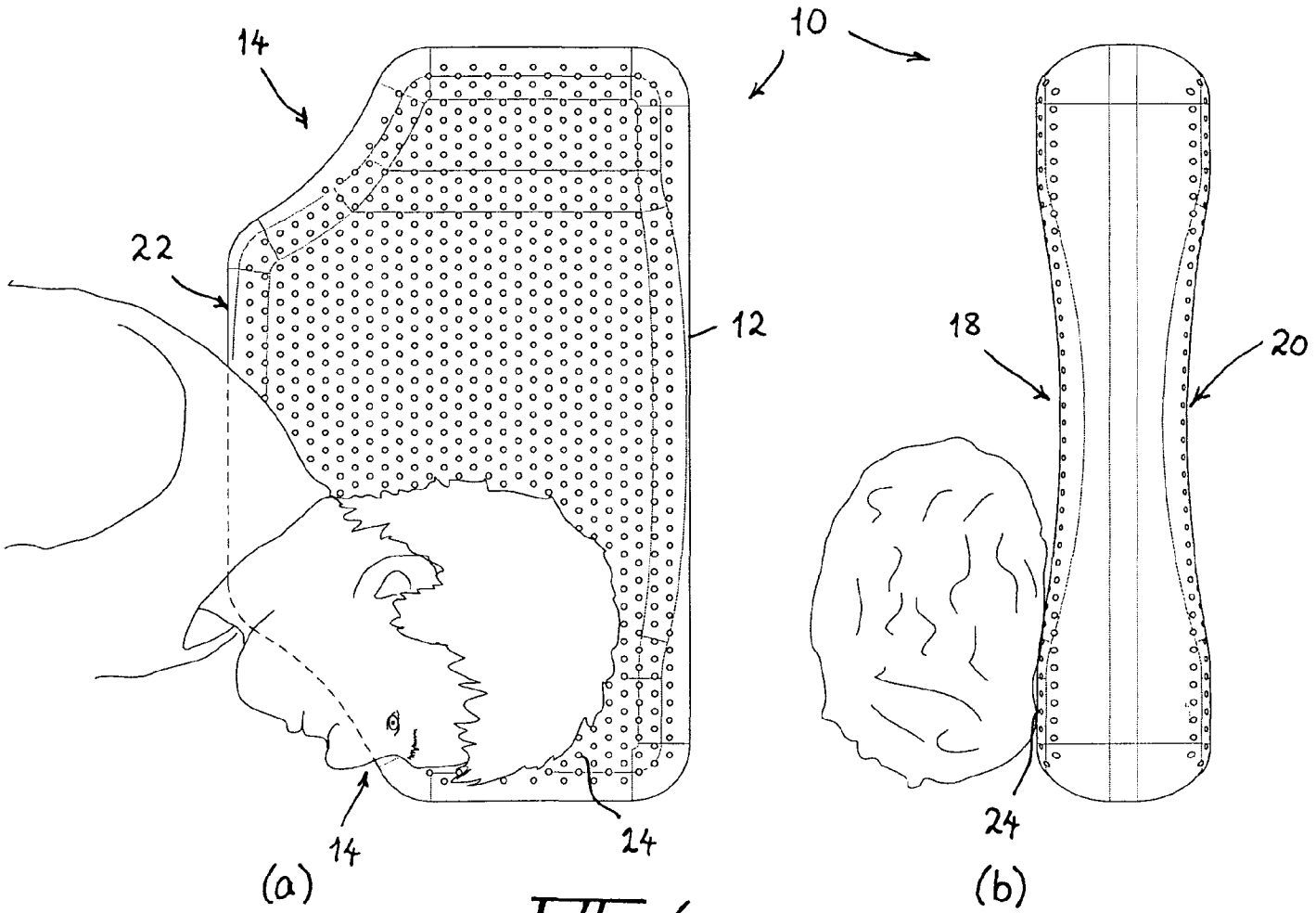
FIGS. 6(*a*) and (*b*) show respectively in top plan view and side elevation how the pillow of FIG. 1 supports the head and neck of a user when sleeping on their side.

Preferably the body 12 has slightly raised sides 24 at each end for supporting the head and neck of a user when sleeping on their side. When sleeping on their side the user's shoulder now defines the height at which the head should be supported above the surface of the bed. Hence, as shown in FIG. 6, the increased height of the sides 24 of the body 12 ensures the head is still properly supported.

Figure 3:
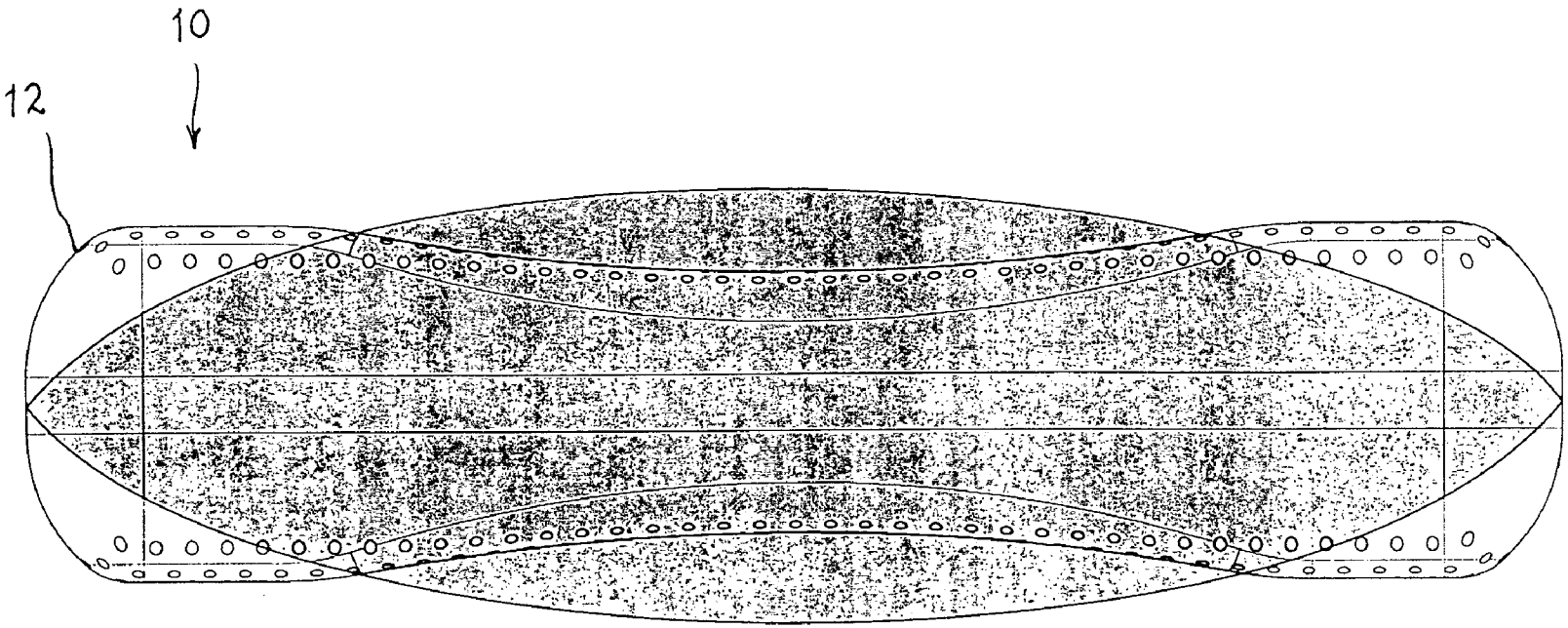
FIG. 3 shows a comparison of the profile of a conventional prior art pillow with the profile of the pillow of FIG. 1.

The improved profile of the body 12 of the pillow 10, also illustrated in FIG. 3, provides additional head and neck support in a way that a conventional pillow is incapable of providing.

Now that a preferred embodiment of the pillow has been described in detail, it will be apparent that the embodiment provides a number of advantages over the prior art, including the following:

(i) It permits unrestricted breathing when a user is sleeping on their side.

(ii) It provides improved head and neck support whether the user is sleeping on their back or side.

(iii) It can be easily manufactured from a foamed cushioning material, such as latex foam, using a mould with the desired profile and contoured shape.

(iv) The density or softness of the pillow can be varied by varying the hole diameter of perforations in the pillow, as well as by varying the distribution of the perforations. Alternatively, the density of the pillow may be varied by using material of different densities to form the pillow.

It will be readily apparent to persons skilled in the relevant arts that various modifications and improvements may be made to the foregoing embodiment, in addition to those already described, without departing from the basic inventive concepts of the present invention. For example, whilst the illustrated embodiment shows the body of the pillow having two corners cut-away to form the recessed portions, the pillow may have one or all four corners cut-away to form one or more recessed portions. Therefore, it will be appreciated that the scope of the invention is not limited to the specific embodiment described.

The invention claimed is:

1. A pillow for sleeping on a bed, the pillow comprising:

a body of generally rectangular configuration having an upper surface and a lower surface joined by a side wall extending around the perimeter of the body, the body being made from a resilient cushioning material and having a corner cut-away to form a recessed portion, the recessed portion having a side wall which is coextensive with the side wall of the body and extends from the upper surface to the lower surface of the body wherein, in use, the recessed portion permits unrestricted breathing when a user is sleeping on their side; and the resilient cushioning material is a foam material, the foam material is perforated, and the perforations pass through the foam material from the upper surface of the body to the lower surface of the body.

2. A pillow as defined in claim 1, wherein the recessed portion is one of a plurality of recessed portions formed in the body of the pillow.

3. A pillow as defined in claim 2, wherein two recessed portions are formed at respective cut-away corners of the body.

4. A pillow as defined in claim 1, wherein the perforations are substantially linear and parallel to one another.

5. A pillow as defined in claim 1, wherein the perforations are of varied diameter and distribution throughout the body of the pillow to vary the density and therefore the softness of the cushioning material.

6. A pillow as defined in claim 1, wherein the perforations are uniformly distributed throughout the body.

7. A pillow as defined in claim 1, wherein the foam material is latex foam.

8. A pillow as defined in claim 1, wherein the upper surface of the body is contoured with a concave shape and is adapted to support the head and neck of a user while sleeping on their back.

9. A pillow as defined in claim 8, wherein the body has slightly raised sides at each end for supporting the head and neck of a user when sleeping on their side.

10. A pillow as defined in claim 1, wherein the lower surface of the body is contoured with a concave shape.

* * * * *